US007526230B2

(12) United States Patent
Kudo et al.

(10) Patent No.: US 7,526,230 B2
(45) Date of Patent: Apr. 28, 2009

(54) MARK SENSING DEVICE, TURNABLE BODY DRIVING DEVICE AND IMAGE FORMING APPARATUS

(75) Inventors: Koichi Kudo, Kanagawa (JP); Hideyuki Takayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 261 days.

(21) Appl. No.: 11/168,478

(22) Filed: Jun. 29, 2005

(65) Prior Publication Data

US 2006/0002739 A1 Jan. 5, 2006

(30) Foreign Application Priority Data

Jul. 2, 2004 (JP) ..... 2004-196696

(51) Int. Cl.
*G03G 15/00* (2006.01)

(52) U.S. Cl. ..... 399/167; 399/301; 250/231.13; 250/237 R

(58) Field of Classification Search ..... 399/303, 399/396, 167, 301; 250/231.13, 237 R
See application file for complete search history.

(56) References Cited

U.S. PATENT DOCUMENTS

| | | | | |
|---|---|---|---|---|
| 3,454,777 | A * | 7/1969 | Marcus | 250/237 R |
| 5,943,639 | A * | 8/1999 | Tanaka et al. | 702/163 |
| 6,252,682 | B1 | 6/2001 | Baba et al. | |
| 6,301,023 | B1 * | 10/2001 | Hirai et al. | 358/498 |
| 6,304,825 | B1 * | 10/2001 | Nowak et al. | 702/94 |
| 6,635,863 | B1 * | 10/2003 | Nihommori et al. | 250/231.13 |
| 6,842,602 | B2 | 1/2005 | Kudo | |
| 2003/0223786 | A1 | 12/2003 | Kamoshita et al. | |
| 2004/0160646 | A1 | 8/2004 | Kudo et al. | |
| 2004/0228663 | A1 | 11/2004 | Kamiya et al. | |
| 2005/0137745 | A1 | 6/2005 | Takayama et al. | |

FOREIGN PATENT DOCUMENTS

| | | |
|---|---|---|
| JP | 6-263281 | 9/1994 |
| JP | 9-114348 | 5/1997 |
| JP | 3107259 | 9/2000 |

OTHER PUBLICATIONS

U.S. Appl. No. 11/169,780, filed Jun. 30, 2005, Kudo et al.

* cited by examiner

*Primary Examiner*—David M Gray
*Assistant Examiner*—Bryan Ready
(74) *Attorney, Agent, or Firm*—Oblon, Spivak, McClelland, Maier & Neustadt, P.C.

(57) ABSTRACT

A mark sensing device of the present invention senses marks formed on a turnable body in a preselected periodic pattern in a direction of movement of the turnable body with light emitted from a light source. A slit mask is formed with slits for splitting the light emitted from the light source. A light receiving portion receives the light thus split and then incident on the mark. The slits of the slit mask each belong to either one of two regions one of which is shifted from the other by one-half of the period of the periodic pattern. The light receiving portion receives the light incident on the mark in each of the two regions and converts the light received to two electric signals. A control signal for controlling the amount of movement of the turnable body is produced from the two electric signals.

24 Claims, 10 Drawing Sheets

MARK SENSING DEVICE, TURNABLE BODY DRIVING DEVICE AND IMAGE FORMING APPARATUS

BACKGROUND OF THE INVENTION

1. Field of the Invention

The present invention relates to a mark sensing device, a device for driving a turnable body and an image forming apparatus.

2. Description of the Prior Art

Today, an image forming apparatus of the type including a photoconductive belt, intermediate image transfer belt or similar turnable body for image formation is extensively used. A prerequisite with this type of image forming apparatus is that the amount of turn or movement of the turnable body be controlled accurately enough to precisely position an image on the turnable body or a recording medium being conveyed by the turnable body. In practice, however, the amount of turn of the turnable body often varies due to some cause and makes it difficult to reduce the shift of an image position. Particularly, in a color image forming apparatus, a change in the amount of rotation prevents images of different colors from being registered at a preselected position, i.e., causes the images of different colors to be shifted in position from each other.

Further, the moving speed, or amount of turn, of the photoconductive belt, intermediate image transfer belt or similar turnable body varies in accordance with, e.g., the variation of the thickness of the belt, the eccentricity of rollers or the irregular speed of a drive motor assigned to the turnable body. Particularly, in a color image forming apparatus, positioning errors ascribable to the irregular speed of the belt appear in the form of a waveform containing a plurality of frequency components. Images of different colors transferred to the belt whose speed is varying one above the other are not accurately registered, resulting in color shift, color variation or similar image defect.

In light of the above, Japanese Patent Laid-Open Publication No. 6-175427, for example, discloses an image forming apparatus in which a rotary encoder is directly connected to the shaft of a drive roller that drives a turnable body or similar rotary shaft. In this configuration, the angular velocity of the drive motor is controlled in accordance with the angular velocity of the turnable body sensed by the encoder. However, it is difficult with this prior art apparatus to accurately control the amount of turn or movement of the turnable body because it is only indirectly controlled via the control of the angular velocity of the drive motor.

To solve the problem stated above, Japanese Patent Laid-Open Publication Nos. 6-263281 and 9-114348 each teach a system configured to sense marks formed on the surface of a belt or turnable body with a sensor and calculate the surface velocity of the belt on the basis of the resulting pulse intervals for thereby feedback-controlling the amount of movement of the belt. This kind of system is capable of directly observing the behavior of the belt surface and therefore directly controlling the amount of turn or movement of the belt. However, neither one of the two Laid-Open Publications mentioned above teaches a method of forming the marks on the belt or a method of sensing the marks. Further, because a belt generally applied to, e.g., an image forming apparatus is flexible, deformable and irregular in thickness, the distance or the angle between the marks formed on the belt and the sensor is caused to vary.

Technologies relating to the present invention are also disclosed in, e.g., U.S. Pat. No. 3,107,259.

SUMMARY OF THE INVENTION

It is an object of the present invention to control the amount of turn of a turnable body with an accurate control signal even when the distance or the angle between marks formed on the surface of the turnable body and a sensor for sensing them is noticeably varied to, in turn, vary the quantity of light to be incident on the sensor.

A mark sensing device of the present invention senses marks formed on a turnable body in a preselected periodic pattern in a direction of movement of the turnable body with light emitted from a light source. A slit mask is formed with slits for splitting the light emitted from the light source. A light receiving portion receives the light thus split and then incident on the mark. The slits of the slit mask each belong to either one of two regions one of which is shifted from the other by one-half of the period of the periodic pattern. The light receiving portion receives the light incident on the mark in each of the two regions and converts the light received to two electric signals. A control signal for controlling the amount of movement of the turnable body is produced from the two electric signals.

A device for driving the turnable body and an image forming apparatus using the above mark sensing device are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, the conventional technologies and problems thereof stated previously will be described more specifically hereinafter.

Figure 1:
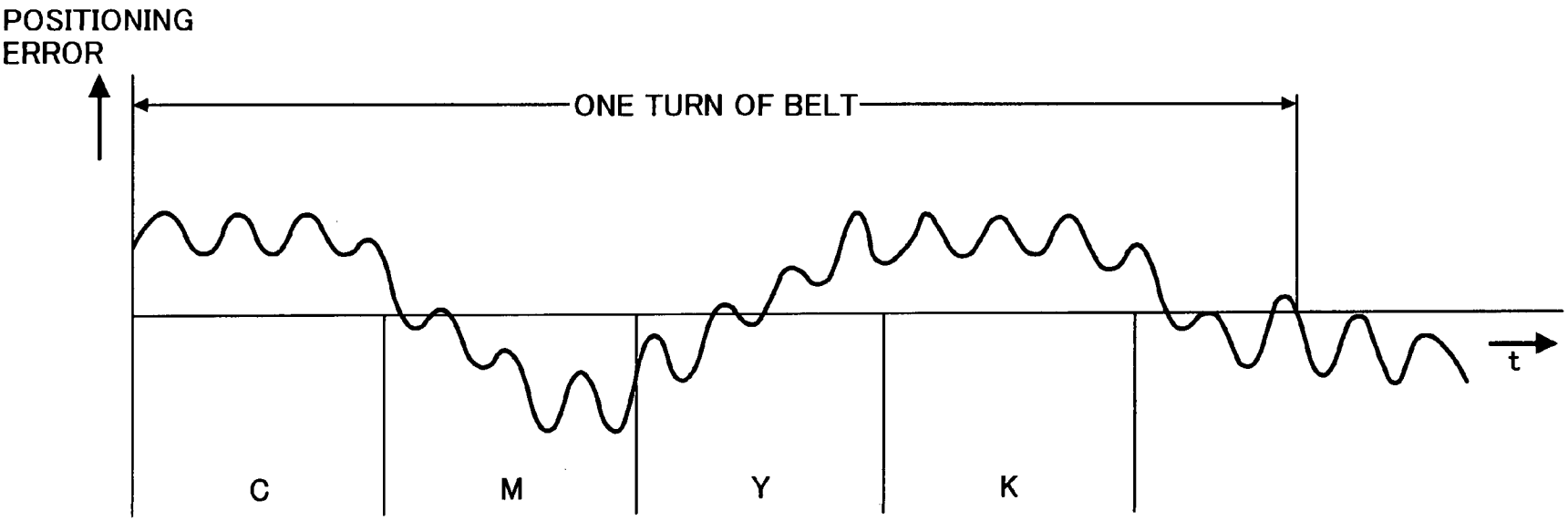
FIG. 1 PRIOR ART
FIG. 1 shows a specific waveform representative of positioning errors ascribable to the variation of velocity of a belt or turnable body generally included in a color image forming apparatus.

To begin with, in an image forming apparatus, the moving speed, or amount of turn, of a photoconductive belt, intermediate image transfer belt or similar turnable body varies in accordance with, e.g., the variation of the thickness of the belt, the eccentricity of rollers or the irregular speed of a drive motor assigned to the turnable body. In a color image forming apparatus in particular, positioning errors ascribable to the irregular speed of the belt appear in the form of a waveform containing a plurality of frequency components, as shown in FIG. 1. It follows that images of different colors transferred to the belt whose speed is varying one above the other are not accurately registered, resulting in color shift, color variation or similar image defect.

Figure 2:
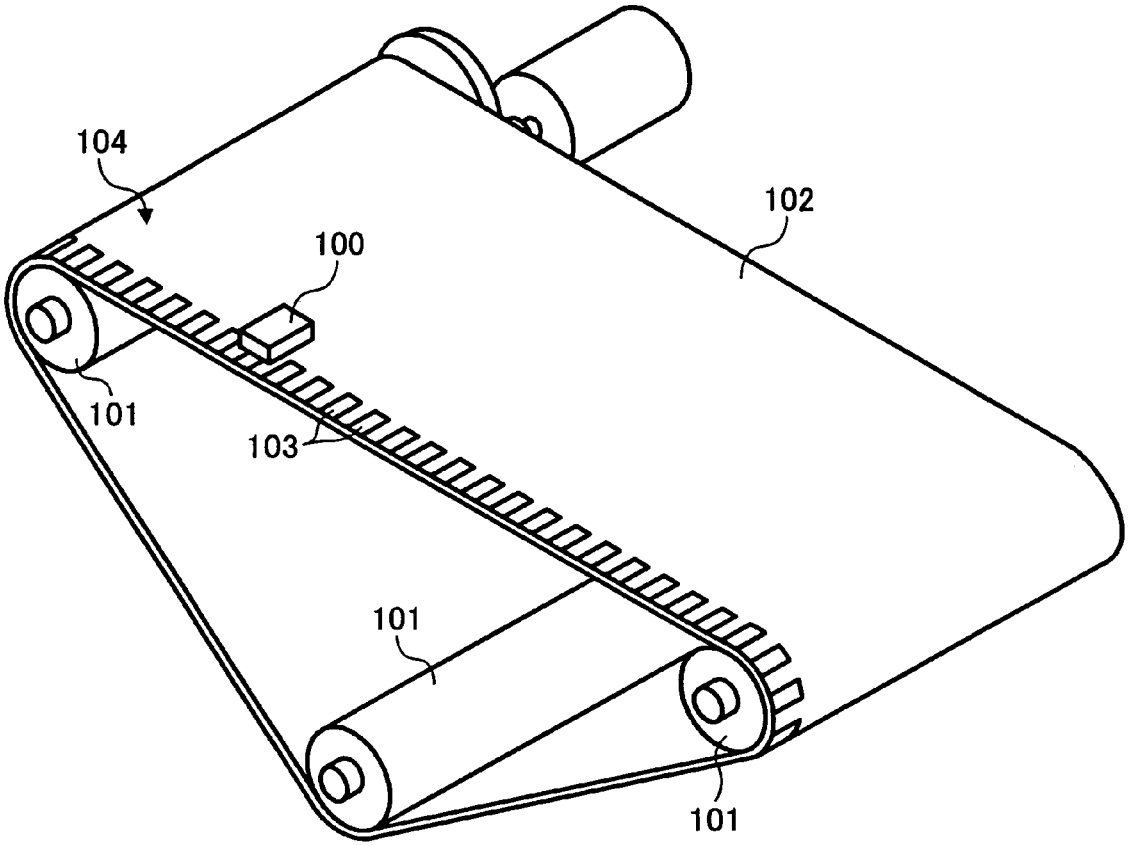
FIG. 2 PRIOR ART
FIG. 2 is a view showing a specific configuration of a conventional mark sensing device using a photointerrupter.

FIG. 2 shows a specific conventional system for sensing marks with a sensor implemented by a photointerrupter. As shown, a belt or turnable body 102 is supported by a plurality of rollers 101 in such a manner as to be movable in a preselected direction. A plurality of marks or reflection marks 104 are arranged at one edge of the surface of the belt 102 at a preselected pitch in the direction of movement of the belt 102, constituting a scale 104. A sensor, implemented by a photointerrupter 100 is located to face the scale 104 and includes an LED (Light Emitting Diode) and a photodiode or photosensitive device although not shown specifically.

Figure 3:
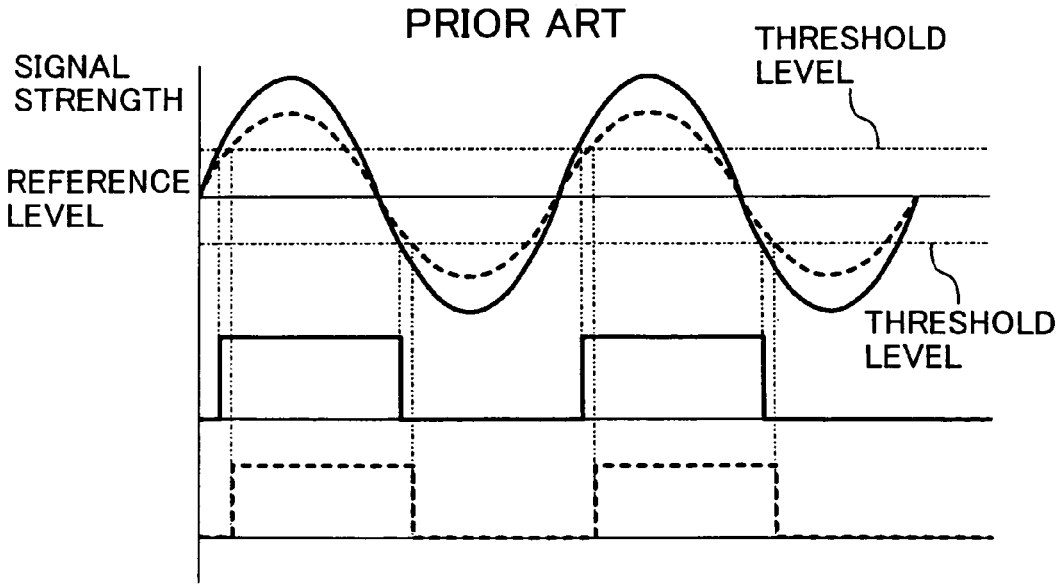
FIG. 3 PRIOR ART
FIG. 3 shows specific electric signals output from the photointerrupter and a binary signal produced therefrom.

In FIG. 3, a solid waveform is representative of an electric signal output from the sensor 100 sensing the marks 103 in the configuration shown in FIG. 2. By contrast, if the belt 102 moves upward or downward or waves when the sensor 100 is sensing the marks 103, then the quantity of light incident on the sensor 100 is caused to vary with the result that the waveform of the electric signal output from the sensor 100 is shifted, as represented by a dashed waveform in FIG. 3. It is to be noted that the waveforms shown in FIG. 3 appear after offsets have been removed from the output of the sensor 100 by, e.g., a high-pass filter.

As shown in FIG. 3, to produce a binary signal or pulse signal for controlling the amount of turn of a turnable body, it is a common practice to determine whether or not an analog AC signal, which swings above and below a reference level (O) is higher or lower in level than the reference level with a comparator. At this instant, noise is contained in the signal or a reference level voltage. In light of this, a circuit generally referred to as a hysteresis circuit or a Schmidt circuit is used to set up threshold values shifted from the reference level slightly upward and downward, respectively, for thereby protecting the signal from instability at the edge portions thereof.

As shown in FIG. 3, the above circuit is capable of producing a binary signal represented by a solid line from the analog electric signal represented by the solid curve so long as the distance and angle between the marks 103 and the sensor 100 remain constant. On the other hand, when the above distance or the angle varies, the circuit produces a binary signal represented by a dashed line from the electric signal represented by the dashed curve. In this manner, when the belt 102 moves upward or downward or waves, i.e., when the distance or the angle between the marks 103 and sensor 100 varies, the edge portions of the binary signal are shifted, and moreover pulse intervals become inaccurate. For example, if the pitch of the marks 103 is 1 mm, then even a measurement error of 1% results in an error of 10 μm, which is not negligible because a single dot available with a 1,200 dpi (dots per inch) color image forming apparatus is about 21 μm. Thus, if the distance or the angle between the marks 103 and the sensor 100 noticeably varies, then the quantity of light incident on the sensor 100 is caused to vary, preventing an accurate control signal for controlling the amount of rotation from being achieved.

Preferred embodiments of the present invention free from the problems stated above will be described hereinafter.

First Embodiment

Figure 4:
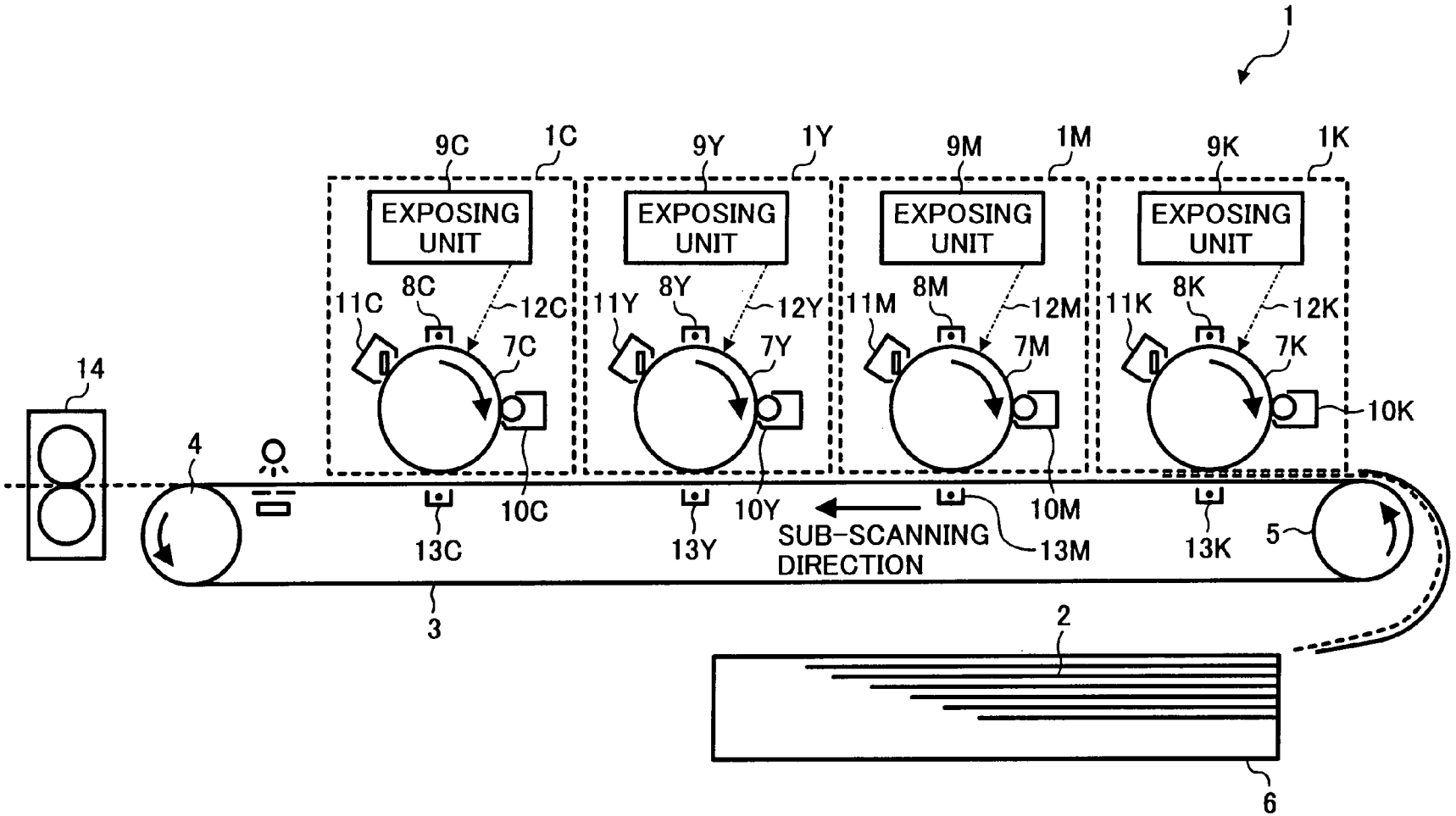
FIG. 4 is a sectional side elevation showing the general construction of a first embodiment of the image forming apparatus in accordance with the present invention.

Reference will be made to FIGS. 4 through 10 for describing a preferred embodiment of the present invention in which a mark sensing device is applied to an image forming apparatus. As shown in FIG. 4, the image forming apparatus, generally 1, is implemented as a tandem, color image forming apparatus including a belt or turnable body 3 for conveying a paper sheet or similar recording medium by way of example. Electronic process units 1K (black), 1M (magenta), 1Y (yellow) and 1C (cyan) are sequentially arranged in this order from the upstream side in a direction in which the belt 3 turns, i.e., it conveys a paper sheet.

The electronic process units (simply process units hereinafter) 1K, 1M, 1Y and 1C, playing the role of an image forming unit each, are configured to form a black, a magenta, a cyan and a yellow toner image, respectively. Because the process units 1K through 1C are identical in configuration with each other except for the color of an image to form, let the following description concentrate on the process unit 1K by way of example. The constituents of the other process units 1M, 1Y and 1C are distinguished from the constituents of the process unit 1K and from each other by suffixes M, Y and C.

The belt 3 is an endless belt passed over a drive roller 4 and a driven roller 5 at opposite ends and caused to turn in a direction indicated by an arrow in FIG. 4 by the drive roller 4. A sheet tray 6 is positioned below the belt 3 and loaded with a stack of paper sheets or recording medium 2. At the time of image formation, the top paper sheet 2 on the sheet tray 6 is paid out from the tray 6 and then caused to electrostatically adhere to the belt 3. The belt 3 in movement conveys the paper sheet 2 thus adhered thereto to the first process unit 1K, so that a black toner image is formed on the paper sheet 2.

More specifically, the process unit 1K includes a photoconductive drum or image carrier 7K and a charger 8K, an exposing unit 9K, a developing unit 10K and a drum cleaner 11K arranged around the drum 7K. In the illustrative embodiment, the exposing unit 9K is implemented as a laser scanner configured such that a laser beam issued from a laser or light source is reflected by a polygonal mirror and then output via optics including an fθ lens and mirrors, although not shown specifically.

To form an image, the charger 8K uniformly charges the surface of the drum 7K to preselected polarity. Subsequently, the exposing unit 9K scans the charged surface of the drum 7K with a laser beam 12K modulated in accordance with black image data, forming a latent image on the drum 7K. The developing unit 10K develops the latent image thus formed on the drum 7K with black toner to thereby produce a black toner image. The black or single-color toner image is transferred by an image transferring device 13M from the drum 7K to the paper sheet 2 being conveyed by the belt 3 at an image transfer position where the drum 7K and paper sheet 2 contact teach other. The drum cleaner 11K removes residual black toner left on the drum 7K after the above image transfer to thereby prepare the drum 7K for the next image formation.

The paper sheet 2, carrying the black toner image thereon, is conveyed to the next process unit 1M by the belt 3. The process unit 1M forms a magenta toner image on a photoconductive drum 7M and then transfers it to the paper sheet 2 over the black toner image present on the paper sheet 2 by the same process as the process unit 1K. Subsequently, when the paper sheet 2 is conveyed to the process unit 1Y by the belt 3, the process unit 1Y transfers a yellow toner image formed on a photoconductive drum 7Y to the paper sheet 2 over the composite black-magenta toner image present on the paper sheet 2. Finally, the process unit 1C transfers a cyan toner image formed on a photoconductive drum 7C to the paper sheet 2 over the composite black-magenta-yellow toner image, thereby completing a full-color or four-color toner image. The paper sheet 2, thus carrying the full-color toner image, is peeled off from the belt 3 and then driven out as a full-color copy via a fixing unit 14.

Figure 5:
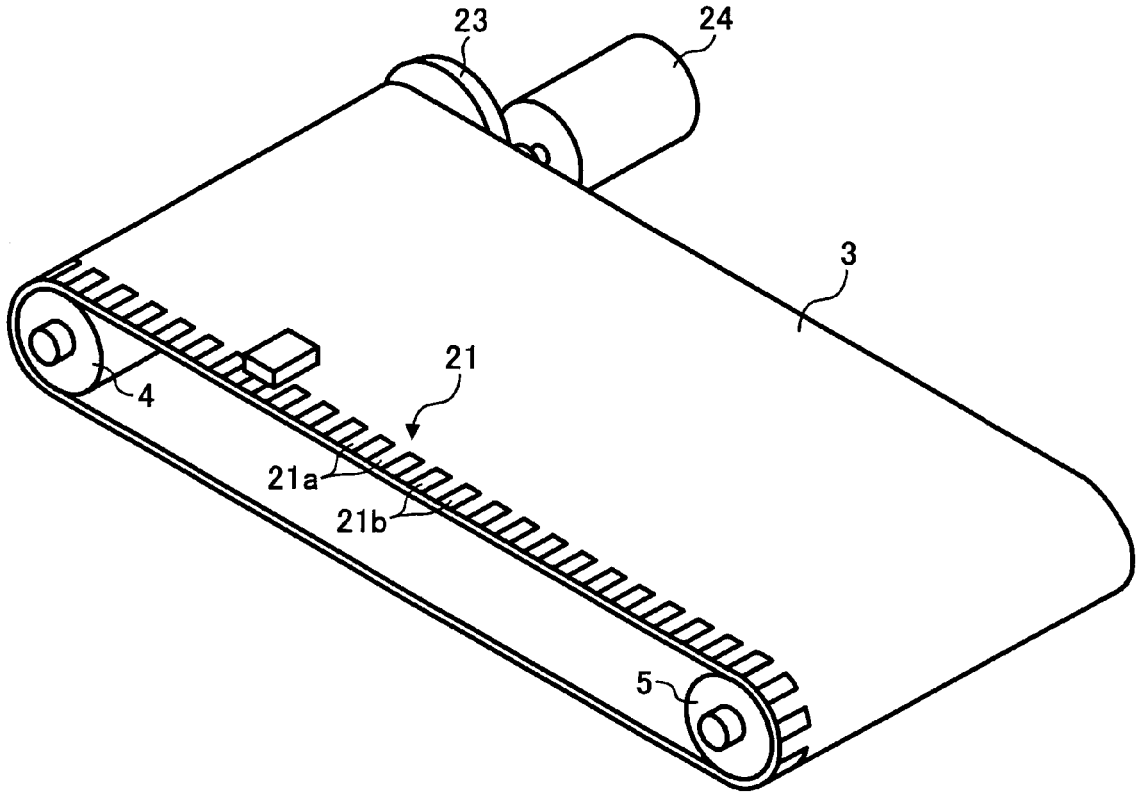
FIG. 5 is an en isometric view showing a belt or turnable body included in the illustrative embodiment.

As shown in FIG. 5, the belt 3 is passed over a drive roller 4 and a driven roller 5 and formed with a scale 21 at one edge thereof. The scale 21 is made up of a plurality of reflection marks 21*a* and a plurality of slits 21*b* alternating with each other in the direction of movement of the belt 3, i.e., in the direction in which the circumferential surface of the belt 3 moves. The reflection marks 21*a* and slits 21*b* are formed at a preselected mark period in a periodic pattern.

In the illustrative embodiment, the reflection marks 21*a* play the role of marks. Alternatively, when an arrangement is made to sense light passed through the slits 21*b*, the slits 21*b* will serve as marks. The gist is therefore that any marks are usable so long as their reflectance or transmittance is variable, e.g., a black and white printed pattern or a full-reflection pattern implemented by a deposited aluminum pattern. The reflection marks 21*a* and slits 21*b* cause a single or a continuous reflectance variation to occur in accordance with their number.

A mark sensor 22 responsive to the reflection marks 21*a* of the scale 21 is located to face the scale 21 at a preselected distance, or sensing distance, from the belt 3. The drive roller 4 is connected to a drive motor 24 via a speed reducer 23 and caused to rotate thereby.

Figure 6:
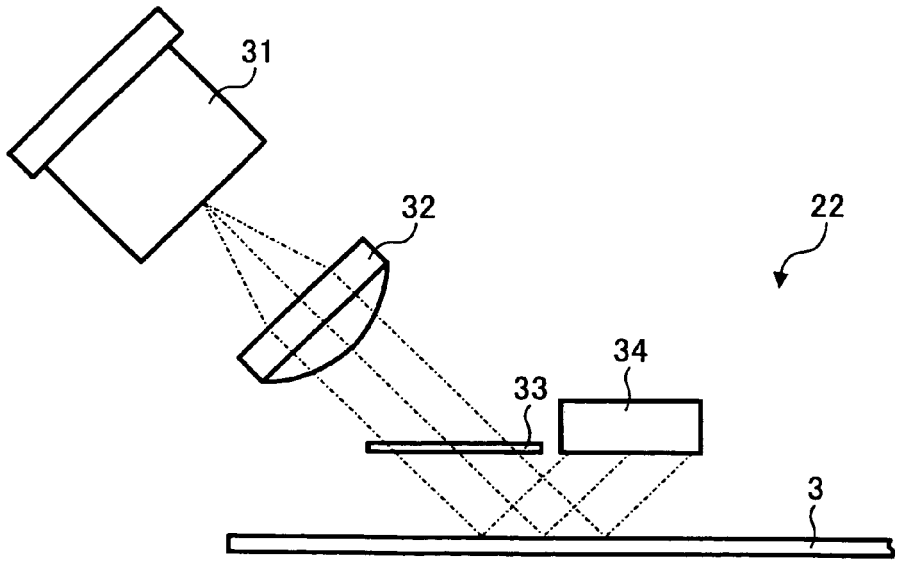
FIG. 6 is a sectional side elevation showing the configuration of a mark sensor also included in the illustrative embodiment.

A specific configuration of the mark sensor 22 is shown in FIG. 6. As shown, the mark sensor 22 includes a light source 31 for emitting a light beam. A lens 32 condenses the light beam emitted from the light source 31 on the scale 21, FIG. 5, formed on the belt 3. A slit mask 33 trims the light beam output from the lens 32 in a desired shape. A light-sensitive device or light receiving portion 34 photoelectrically transduces light reflected and scattered by the reflection marks 21*a* of the scale 21 and input thereto. The mark sensor 22 may additionally include a lens for condensing the light reflected and scattered by the reflection marks 21 on the light-sensitive device 34, if desired.

The mark sensor 22 with the above configuration serves as a sensor in which the light source 31 emits a light beam toward the scale 21 while the light-sensitive device 34 senses light reflected from the scale 21. Specifically, by sensing light reflected from the reflection mark 21*a* of the scale 21, the mark sensor 22 produces information representative of a relative position between the reflection mark 21*a* and the mark sensor 22 itself. More specifically, the reflectance of the light beam reflected by the scale 21 differs from the reflection marks 21*a* to the slits 21*b*, so that the quantity of light reflected or scattered by the reflection marks 21*a* varies. The mark sensor 22 senses such a variation of the quantity of light with the light-sensitive device 34 for thereby determining the position of the mark 21*a*.

While the light source 31 is implemented by an LED by way of example, it may be replaced with a semiconductor laser or an electric bulb, if desired. A semiconductor laser or an LED or spot light source having a small emission area is desirable because the light beam should preferably be highly parallel. The lens 32 should preferably be implemented as, e.g., a collimator lens. The light-sensitive device 34 should only be able to transform the intensity of light to an electric signal and may be implemented by a photodiode or a phototransistor by way of example.

Figure 7A:
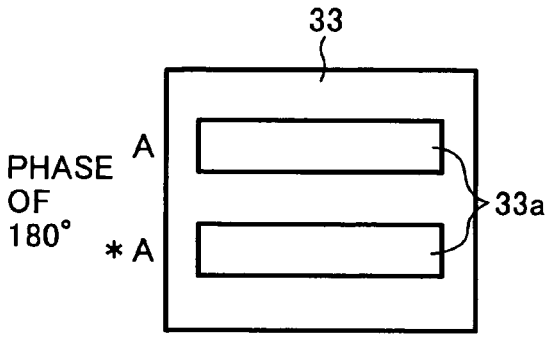
FIG. 7A is a plan view showing a specific configuration of a slit mask further included in the illustrative embodiment.
Figure 7B:
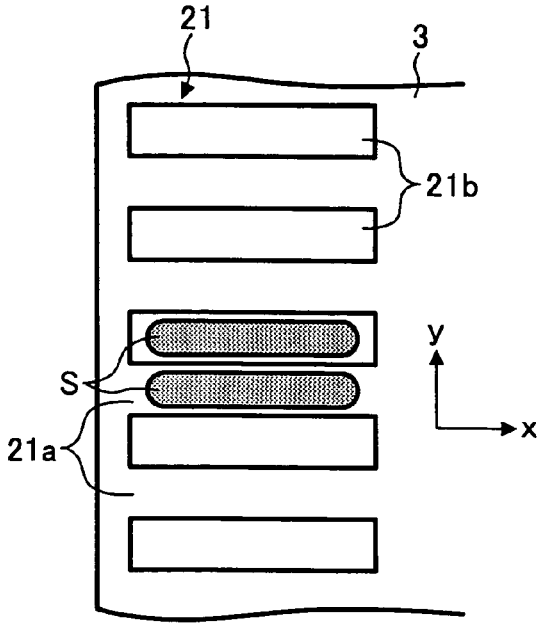
FIG. 7B is a plan view showing a scale on which a light beam is incident via the slit mask of FIG. 7A.

In the illustrative embodiment, a slit mask, see FIG. 7A, is formed with a plurality of slits 33*a* that pass light therethrough. The slits 33*a* are openings formed in a preselected pattern for providing light to be incident on the scale 21 with a preselected shape. More specifically, FIG. 7A is a plan view showing a specific case wherein the slit mask 33 is formed with two slits 33*a*. FIG. 7B is also a plan view showing the scale 21 on which a light beam is incident via the slit mask 33.

As shown in FIG. 7A, the slit mask 33 is formed by dividing the two slits 33*a* into two regions A and *A and shifting one region A from the other region *A by one-half of the mark period. More specifically, one of the two slit 33*a* is shifted from the other slit 33*a* by one-half of the mark period. With this configuration, the slit mask 33 splits the light beam incident thereon into two light beams S and causes them to form two spots on the scale 21, as shown in FIG. 7B. The two beam spots S are therefore shifted from each other by one-half of the mark period.

The mark sensor 22 senses one spot S formed on the scale 21 and then senses the other spot S shifted from the above spot S by one-half of the mark period, outputting two consecutive electric signals shifted from each other by one-half of the mark period, i.e., shifted in phase by 180°.

Figure 8A:
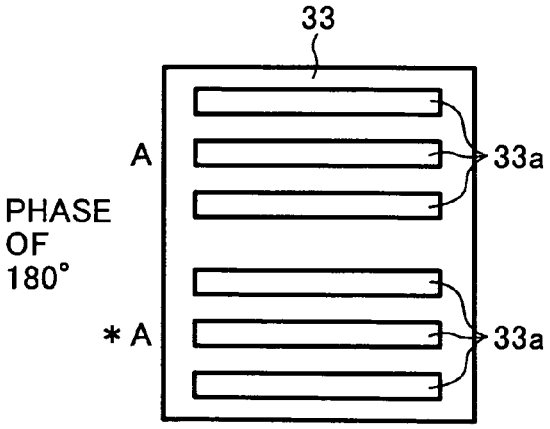
FIG. 8A is a plan view showing another specific configuration of the slit mask.
Figure 8B:
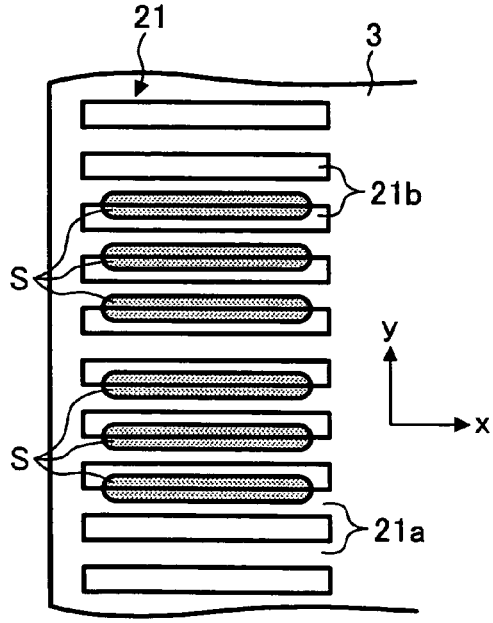
FIG. 8B is a plan view showing the scale on which a light beam is incident via the slit mask of FIG. 8A.

It is to be noted that the number of slits formed in the slit mask 33 is not limited to two. For example, as shown in FIG. 8A, six slits 33*a* may be formed in the slit mask 33. In this case, the light beam will form six beam spots S on the scale 21 via the slit mask 33, as shown in FIG. 8B.

More specifically, the slit mask 33 is formed by dividing the six slits 33*a* into two regions A and *A, each including three slits, and shifting one region A from the other region *A by one-half of the mark period. With this configuration, the slit mask 33 splits the light beam into six light beams and causes them to form six beam spots S on the scale 21, as shown in FIG. 8B. Consequently, the three beam spots of the region A are shifted from the three beam spots of the other region *A by one-half of the mark period. The mark sensor 22 senses three spot S formed on the scale 21 and then senses the other three spot S shifted from the above spots S by one-half of the mark period, outputting two consecutive electric signals shifted from each other by one-half of the mark period, i.e., shifted in phase by 180°.

While the two regions A and *A are shifted by one-half of the mark period in the illustrative embodiment, such a configuration is only illustrative. For example, the regions A and *A may be shifted from each other by (2n+1)/2 of the mark period where n is a natural number, or nonnegative integer, inclusive of zero, i.e., n=0, 1, 2, . . . .

Preferably, the two regions A and *A of the slits 33*a* should be divided from each other in the direction of movement of the scale 21. More specifically, hardly any problem arises in the case of a transmission type or a vertical input type of optical arrangement. On the other hand, in a reflection type of optical arrangement and in a layout that requires, e.g., the light beam to be obliquely incident to the scale 21, the light beam should preferably not be provided with an angle relative to the direction of movement of the scale 21. It is therefore preferable to provide the phase difference in the direction of movement of the scale 21 so as not to disturb the balance of the quantities of reflected light even when the sensing distance, e.g., the distance between the scale 21 and the mark sensor 22 varies.

Further, as shown in FIGS. 7B and 8B, the slits 21*b* of the scale 21 each are formed, e.g., oblong to be broad in a direction x perpendicular to a direction y in which the belt 3, i.e., the scale 21 moves. Also, as shown in FIGS. 7B and 8B, the light beams or spots S incident on the scale 21 each should preferably not be circular, but should be oblong in the above direction x. Thus, to prevent the quantity of light sensed from varying even when the scale 21 is locally smeared or lost, the light beams incident on the scale 21 each are provided with a shape sized one-half of the mark period in the direction of movement of the scale 21 and smaller than the lengthwise size of each slit 21, as measured in the direction perpendicular to the direction of movement of the scale 21, but as large as possible. Such an oblong beam configuration is obtainable not only with the slit mask 33 but also with a cylindrical lens or a wedge prism that scatters only one side or with a diffracting optical device that splits a single beam into a plurality of beams.

As stated above, the slits 33*a* of the slit mask 33 and the slits 21*b* of the scale 21 each are formed relatively broad in the direction perpendicular to the direction of movement of the belt 3. This not only insures accurate, stable mark sensing against the tilting or the meandering of the belt 3, but also allows electric signals to be surely output even when the marks of the scale 21 are partly smeared or lost.

Figure 9:
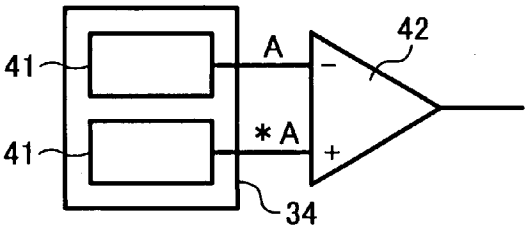
FIG. 9 is a plan view showing a specific configuration of a light-sensitive device included in the illustrative embodiment.

FIG. 9 shows a specific configuration of the light-sensitive device 34. As shown, the light-sensitive device 34 has two light-sensitive areas 41 respectively receiving the two light beams of different phases. The light-sensitive areas 41 are connected to a comparator 42, which may be implemented as an amplifier. If desired, the two light-sensitive areas 41 may be replaced with two independent light-sensitive devices 34 each receiving one of the light beams.

With the above configuration, the light-sensitive device 34 transforms the light beams incident on the two light-sensitive areas 41 to electric signals that respectively correspond to the two regions A and *A. As a result, an A-phase signal and an *A-phase or opposite-phase signal are respectively output from the two light-sensitive areas 41 of the light-sensitive device 34. It is to be noted that the *A-phase signal is an inverted signal whose offset varies in the same phase as the offset of the A-phase signal. In the illustrative embodiment, a binary signal or pulse signal for controlling the amount of rotation of the belt 3 is produced from the A-phase and *A-phase signals. More specifically, the A-phase and *A-phase signals are compared to produce a binary signal that remains highly accurate against the variations of offset and signal amplitude.

Figure 10:
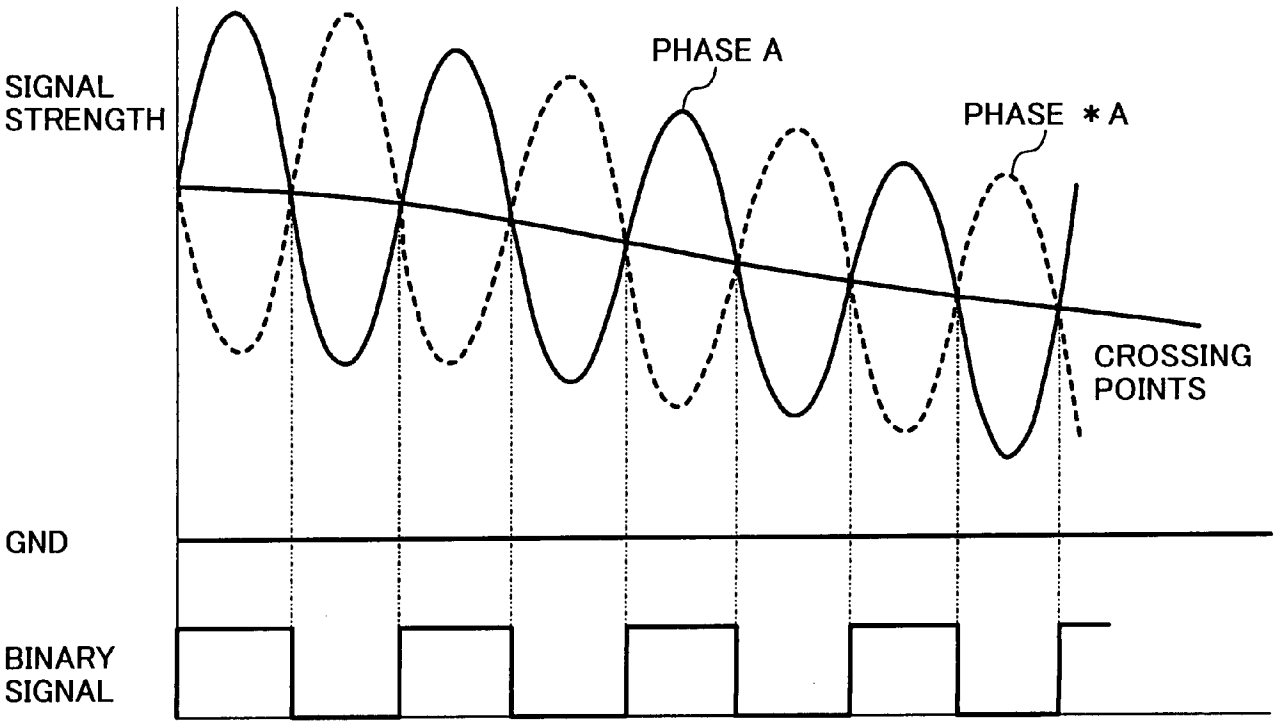
FIG. 10 shows specific electric signals output from the light-sensitive device of FIG. 10 and a binary signal produced therefrom.

FIG. 10 shows specific electric signals output from the light-sensitive device 34 and a binary signal derived from the electric signals. As shown, the A-phase and *A-phase signals are binarized by using the crossing points of the two signals as threshold values; a crossing point refers to a position where the result of subtraction of the two signals is zero. This allows accurate edges to be output despite any change in signal. In the illustrative embodiment, so producing a binary signal from the A-phase and *A-phase signals by using the crossing points of the two signals as threshold values constitutes signal generating means. Alternatively, the binary signal may be produced from a difference signal representative of a difference between the A-phase and *A-phase signals, in which case in-phase offsets are removed from the difference signal to double the amplitude of the difference signal.

It is noteworthy that the differential output of the A-phase and *A-phase signals corresponds to the offset component of the quantity of light reflected by the reflection mark 21*a* of the scale 21 and can therefore be used to, e.g., examine the smearing of the scale 21, to control the quantity of light to be emitted from the light source 31 or to control the amplification ratio of an amplifier not shown.

As stated above, when the scale 21 moves in accordance with the movement of the belt 3, the mark sensor 22 outputs two different electric signals matching with the moving speed of the scale 21. Subsequently, a binary signal is produced from the above electric signals, and then the drive of the belt 3 is so controlled as to maintain the amount of rotation of the belt 3 constant in accordance with the binary signal. In the illustrative embodiment, such a procedure constitutes control means. More specifically, the mark sensor 22 receives light beams reflected from the two areas A and *A of the individual reflection mark 21*a* shifted in phase from each other by one-half of the mark period. The mark sensor 22 then converts the input light beams to corresponding electric signals also shifted by half a phase. The electric signals are used to generate a binary signal for controlling the amount of rotation of the belt 3.

The illustrative embodiment stated above has various unprecedented advantages to be described hereinafter. A binary signal for controlling the amount of rotation of the belt 3 is produced from two electric signals different in phase from each other by one-half of the mark period, i.e., by 180°. It is therefore possible to maintain the binary signal accurate even when the quantity of light incident on the mark sensor 22 varies due to the variation of the distance or the angle between the scale 21 and the mark sensor 22 itself. Further, it is possible to see the offset level of the entire signals and therefore the reflection condition of the scale 21. In addition, by controlling the amount of rotation of the belt 3 with a PLL (Phase Locked Loop) circuit to which the binary signal is applied, it is possible to allow the belt 3 to convey the paper sheet 2, FIG. 4, with accuracy.

In the illustrative embodiment, a laser beam is split by the two regions A and *A shifted from each other by one-half of the mark period to thereby output two electric signals also different in phase from each other by half a period, i.e., by 180°, allowing the marks to be stably sensed without regard to the smears or the local omission of the scale 21. Particularly, when more than two slits 21*b* are formed in the sale 21, the light beam is split into more than two and then sensed at the same time, further promoting the stable sensing of the marks.

The mark sensor 22 included in the illustrative embodiment is used as an encoder sensor for measuring the positions of rollers or positioning the rollers and an endless belt, which are included in an electrophotographic apparatus, ink jet printer or similar image forming apparatus, so that the entire quantity of light or the offset level is apt to vary due to a change in the height of the scale 21 or a smear. However, the mark sensor 22 is capable of accurately sensing the positions of the individual reflection marks 21 of the scale 21.

In the illustrative embodiment, the belt 31 or an intermediate image transfer belt on which the scale 21 is formed of resin and about 0.1 mm thick and is therefore likely to deform or slack by way of example. Further, the direction of deformation is not limited to the direction of rotation of the belt, but is sometimes angled about the center of rotation of the belt. For example, when a circular beam and a circular mark are used, the mark and light beam are misaligned due to the variation of the above angle. Moreover, it is likely that the belt meanders perpendicularly to the direction of rotation and brings the light beam and mark out of alignment in the direction of rotation, making signals unavailable at all. To solve such problems, in the illustrative embodiment, the slits 33*a* of the slit mask 33 are formed relatively broad in the direction perpendicular to the direction of movement of the belt 3 for thereby insuring accurate mark sensing against the tilting and meandering, among others, of the belt 3.

It is generally recommended to tilt a reflection type photointerrupter relative to the direction of movement of marks when reading the marks. For this reason, the optical axis and the sensing surface of the photointerrupter are, in many cases, inclined relative to each other. Therefore, if the photointerrupter is positioned such that the optical axis and a line normal to the sensing surface are inclined by an angle of $d\theta$ relative to the direction of movement of the marks, then when the sensing surface varies by a preselected amount of dz, the position of the resulting beam spot is shifted by $dz \cdot \tan(d\theta)$. In this manner, when the optical axis of the photointerrupter is not perpendicular to the sensing surface, there occurs an error in the position of the mark sensed. By contrast, in the illustrative embodiment, the light source 31 is not inclined relative to the direction of movement of the belt 3, allowing the marks to be stably, accurately sensed.

Second Embodiment

Figure 11:
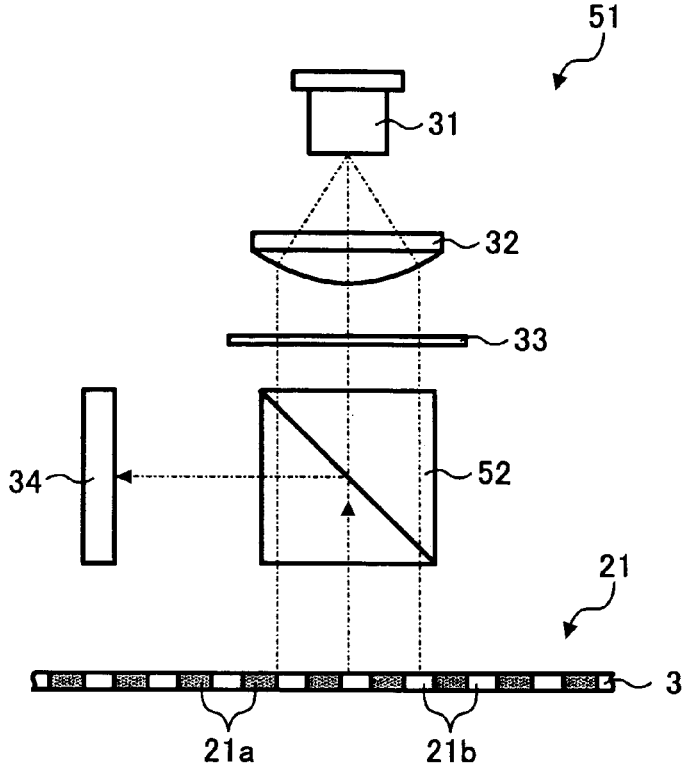
FIG. 11 is a vertical section showing a mark sensor representative of a second embodiment of the present invention.

Referring to FIG. 11, an alternative embodiment of the present invention will be described which is essentially similar to the first embodiment described above except for the following. In the illustrative embodiment, parts and elements identical with those of the first embodiment are designated by identical reference numerals and will not be described specifically in order to avoid redundancy. Let the following description concentrate on arrangements unique to the illustrative embodiment.

As shown in FIG. 11, a mark sensor 51 also includes the light source 31 for emitting a light beam, the lens 32 for condensing the light beam emitted from the light source 31 on the scale 21, and the slit mask 33 for shaping the light beam output from the lens 32 with the slits 33*a*, see FIGS. 7A and 7B or 8A and 8B. In the illustrative embodiment, the mark sensor 51 further includes a deflector 52 for deflecting light passed through the slit mask 33 and then reflected and scattered by the scale 21. A light beam output from the deflector 52 is incident on the light-sensitive device or light receiving portion 34, which performs photoelectric transduction.

As stated above, in the illustrative embodiment, the light beam emitted from the light source 31 is incident perpendicularly on the scale 21, so that the marks can be accurately, stably sensed despite the up-down movement or the variation of the angle of the belt 3. Of course, the illustrative embodiment achieves the other advantages stated in relation to the first embodiment as well.

If the light beam is angled, then the position where the light beam is reflected is apt to vary and bring about measurement errors. To solve this problem, the light source 31 is positioned such the light beam emitted therefrom is incident perpendicularly on the individual reflection mark 21*a*. This allows the marks to be accurately sensed without any error even when the distance between the mark sensor 22 and the scale 21 or the sensing angle varies.

Third Embodiment

Figure 12:
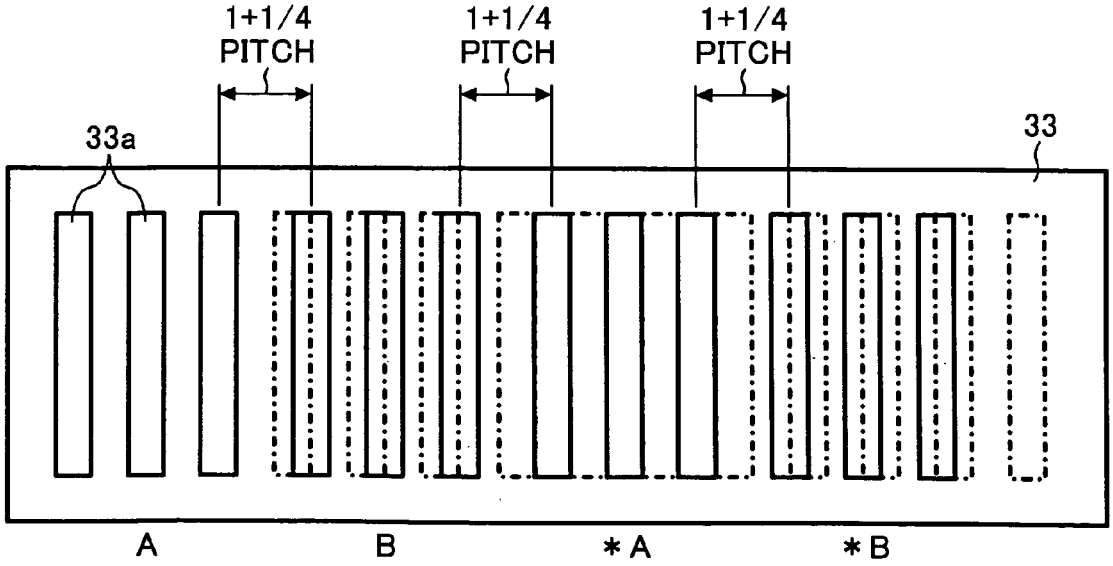
FIG. 12 is a plan view showing a slit mask representative of a third embodiment of the present invention.
Figure 13:
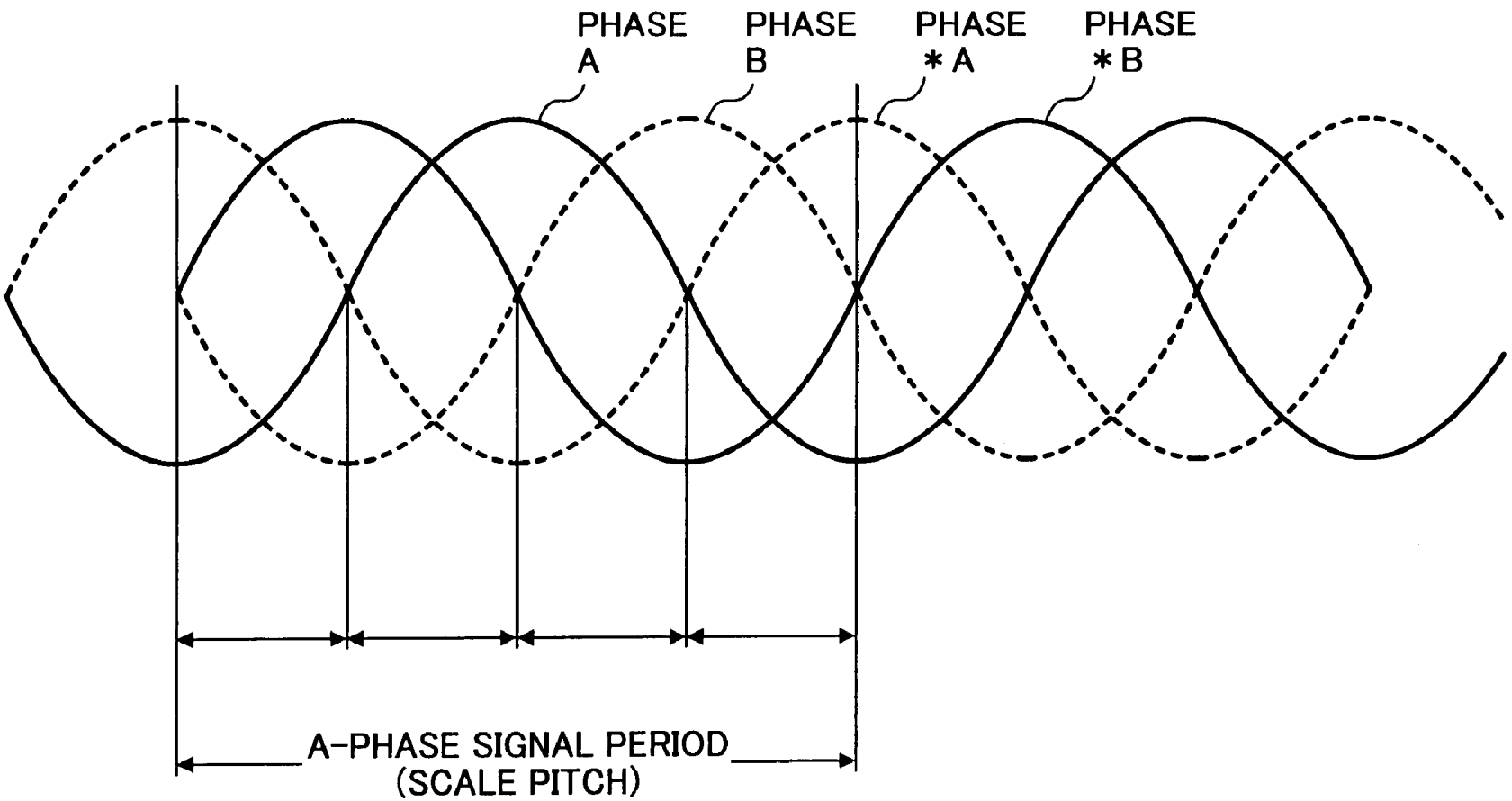
FIG. 13 shows specific electric signals output from a photosensitive-element included in the third embodiment.

FIGS. 12 and 13 show another alternative embodiment of the present invention which is essentially similar to the first embodiment except for the following. In the illustrative embodiment, parts and elements identical with those of the first embodiment are designated by identical reference numerals and will not be described specifically in order to avoid redundancy. Let the following description concentrate on arrangements unique to the illustrative embodiment.

FIG. 12 shows a slit mask included in the illustrative embodiment while FIG. 13 shows electric signals output from the light-sensitive device. As shown in FIG. 12, the slit mask 33 is formed with twelve slits 33*a* in total in four consecutive regions A, B, *A and *B each of which is shifted from adjoining one by one-fourth of the mark period. More specifically, three of the twelve slits 33*a* are shifted from nearby three by one-fourth of the mark period. In this configuration, the light beam is divided by the slit mask 33 into twelve beam spots or light beams and then incident on the scale 21. Three of the twelve spots are therefore shifted from nearby three by one-fourth of the mark period.

In the illustrative embodiment, the light-sensitive device 34 is provided with four light-sensitive regions 41, FIG. 9, corresponding to the four regions A, B, *A and *B of the light beam, respectively. Alternatively, use may be made of four light-sensitive devices 34 each for receiving one of the split light beams, if desired.

While the four regions A, B, *A and *B are shifted by one-fourth of the mark period in the illustrative embodiment, such a configuration is only illustrative. For example, the regions A through *B may be shifted from each other by $(2n+1)/4$ of the mark period where n is a natural number, or nonnegative integer, inclusive of zero, i.e., n=0, 1, 2, . . . .

In the illustrative embodiment, the four regions A through *B are sequentially arranged in this order with their phases being shifted by each ¼ pitch. However, such an order is only illustrative and may be replaced with any other suitable order so long as it allows the electric signals to be distinguished from each other. This is because a signal in the phase B is shifted in phase from a signal in the phase A by, e.g., 90°, a signal in the phase *A is shifted by 180°, and a signal in the phase *B is shifted by 270°. Also, the regions A through *B do not have to be arranged in the direction of movement of the scale 21. For example, the regions A and B may be positioned side by side perpendicularly to the direction of movement of the scale 21. In such a case, the regions A and *A and the regions B and *B each should preferably be positioned next to each other in the direction of movement of the scale 21 for removing offsets stated earlier and other purposes.

As stated above, as shown in FIG. 13, among the electric signals derived from the light beams different in phase from each other, the A-phase and B-phase signals are different in phase from each other by 90° and can therefore be dealt with in the same manner as an A-phase and a B-phase signal customary with an encoder. This implements, e.g., quadruple counting on the basis of the combination of signals. Of course, the illustrative embodiment also achieves the other advantages stated in relation to the first embodiment as well.

Fourth Embodiment

Figure 14:
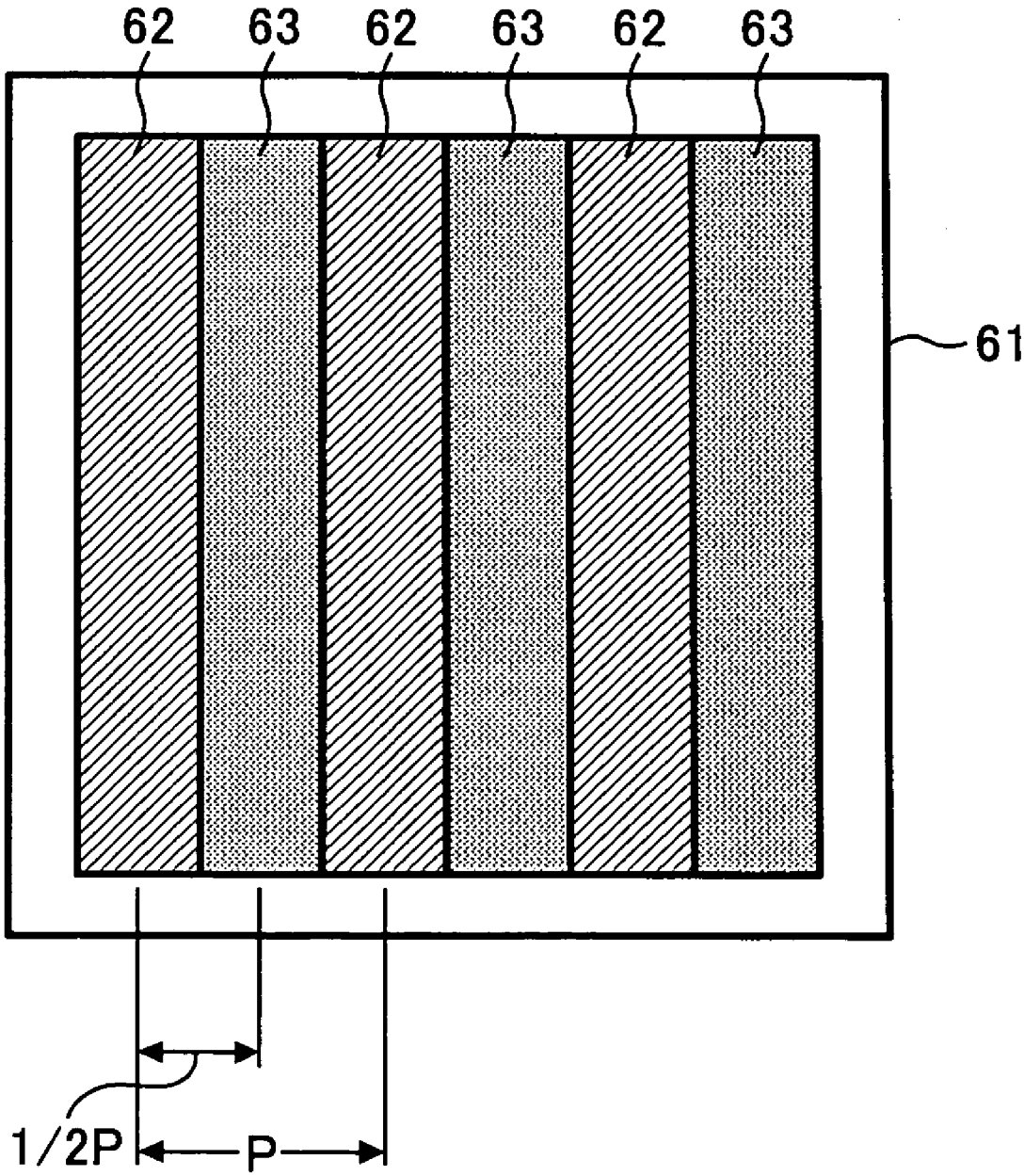
FIG. 14 is a plan view showing a polarization split mask representative of a fourth embodiment of the present invention.

FIG. 14 shows still another alternative embodiment of the present invention which is essentially similar to the second embodiment except for the following. In the illustrative embodiment, parts and elements identical with those of the second embodiment are designated by identical reference numerals and will not be described specifically in order to avoid redundancy. Let the following description concentrate on arrangements unique to the illustrative embodiment.

As shown in FIG. 14, the illustrative embodiment uses a polarization split mask 61 in place of the slit mask 33. The polarization split mask 61 is formed with P-polarization intercept regions 62 and S-polarization intercept regions 63 identical in shape with the slits 33*a*. The P-polarization and S-polarization intercept regions 62 and 63 alternate with each other at a periodic pattern identical with the mark period or periodic pattern of the reflection marks 21*a*. The P-polarization and S-polarization intercept regions 62 and 63 intercept the P-polarization component and S-polarization component of light, respectively.

In the illustrative embodiment, a light beam is emitted toward the scale 21 via the polarization split mask 61. While this light beam appears to be uniform in intensity, it consists of polarized beams arranged in the form of slits.

The deflector 52 is implemented as a polarization beam splitter by way of example. Because the scale 21 consists of full-reflection slits or transmission slits and therefore the light beam incident on the light-sensitive device 34 maintains the polarizations, the light-sensitive device 34 can receive the deflected components if the light beam is split by, e.g., a beam splitter and the resulting polarized components are individually subject to photoelectric transduction or if the light beam is split into two light beams and then input to a light-sensitive device provided with a polarizing filter.

As stated above, in the illustrative embodiment, the two polarized beams are incident on the scale 21 at positions shifted from each other by half a pitch. The illustrative embodiment can therefore output an A-phase and a *A-phase signal opposite in phase to each other like the second embodiment. Of course, the illustrative embodiment is comparable with the second embodiment as to the other advantages, too.

To remove offsets, nearby slits 33*a* should preferably, if possible, be shifted in phase from each other. However, as for the slit mask 33, if light beams, each having a width of half a pitch, adjoin each other at positions shifted by half a pitch, then the beams simply form a single opening together. On the other hand, by generating signals of opposite phases at nearby positions of the scale 21 by using the polarization of light, it is possible to reduce a difference in the quantity of reflection between the signals ascribable to smears or defects for thereby enhancing the removal of offsets and realizing stable mark sensing.

Fifth Embodiment

A further alternative embodiment of the present invention will be described with reference to FIG. 15. In the illustrative embodiment, the mark sensing device is applied to an image forming apparatus, more specifically a turnable body driving device included therein. Because the illustrative embodiment is essentially similar to the first embodiment, identical parts and elements are designated by identical reference numerals and will not be described specifically in order to avoid redundancy. Briefly, in the illustrative embodiment, the scale 21 is formed on one edge of an intermediate image transfer belt or turnable body 202 included in an image forming apparatus 200.

Figure 15:
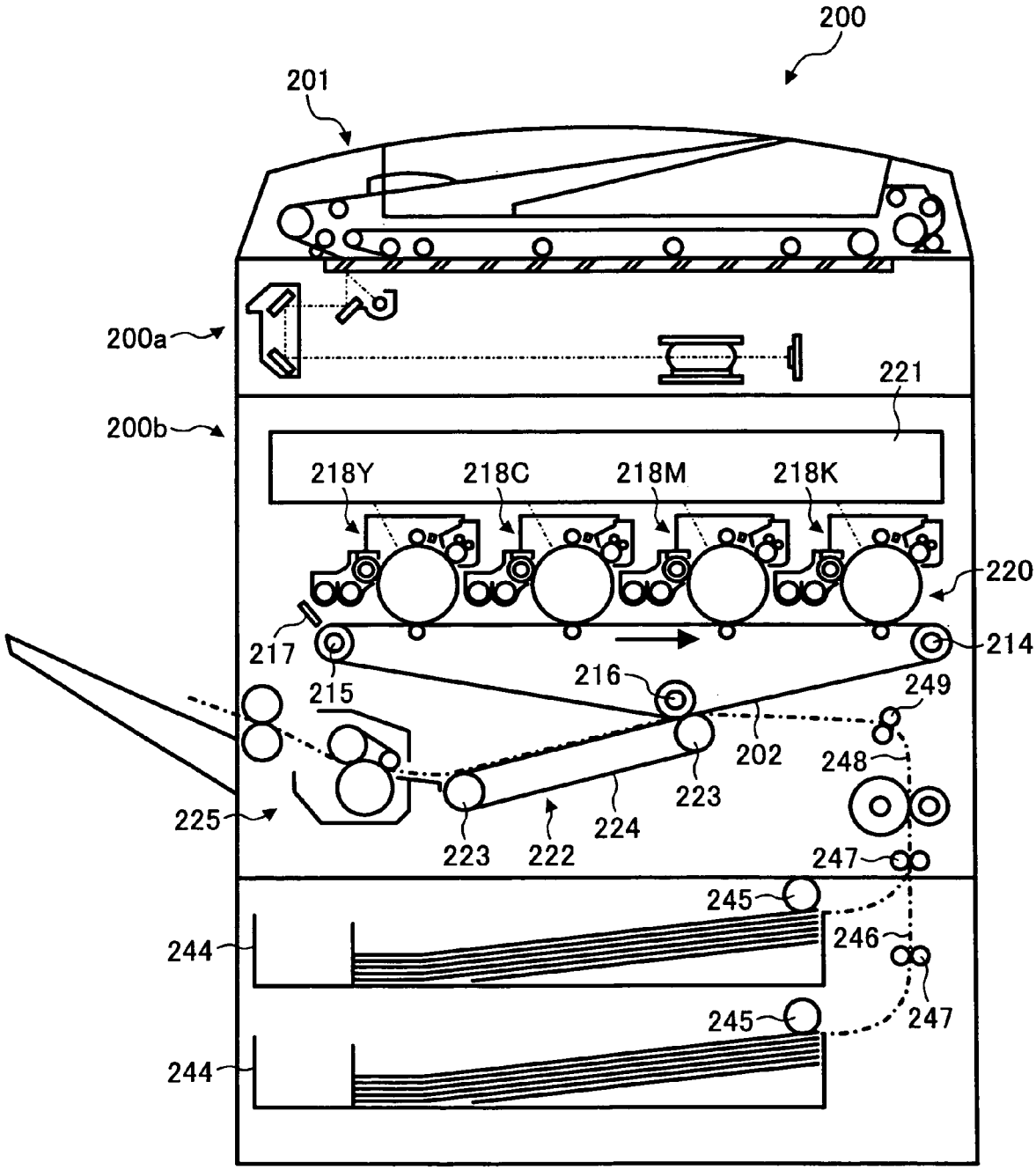
FIG. 15 is a sectional side elevation showing an image forming apparatus representative of a fifth embodiment of the present invention.

More specifically, as shown in FIG. 15, the image forming apparatus 200 includes a scanner 200*a* for reading a document image, a printer 200*b* for forming an image in accordance with the resulting image data with an electrophotographic system, and a control unit, not shown, for controlling the entire apparatus 200 with a microcomputer and other devices. An ADF (Automatic Document Feeder) 201 is mounted on the scanner 200*a*. The printer 200*b* is arranged below the scanner 200*a*.

The printer 200*b* is a tandem, intermediate image transfer type of electrophotographic device and includes an endless, intermediate image transfer belt or intermediate image carrier 202 located at the center. The intermediate image transfer belt (simply belt hereinafter) 202 is made up of a base layer, an underlayer formed on the base layer and implemented by, e.g., fluoroplastic scarcely stretchable or stretchable rubber and canvas, and an elastic layer formed on the underlayer, although not shown specifically. The elastic layer is formed of fluororubber or acrylonitrile-butadiene copolymer rubber by way of example. The surface of the elastic layer is covered with a highly smooth coating layer implemented by, e.g., fluoroplastic.

The belt 202 is passed over three support rollers 214, 215 and 216 and driven to turn clockwise, as viewed in FIG. 15. A belt cleaner 217 is positioned at the left-hand side of the second support roller 215, as viewed in FIG. 15, and configured to remove residual toner left on the belt 202 after image transfer.

Arranged above the belt 202 is a tandem, image forming section 220 in which four printer engines 218Y, 218M, 218C and 218K each for forming a toner image of a particular color are arranged side by side in the direction of movement of the belt 202. The printer engines 218Y through 218K each include a photoconductive drum or image carrier and a charger, a developing unit and other process units arranged around the drum. An exposing unit 221 is positioned above the image forming section 220 and configured to optically write latent images on the drums of the printer engines 218Y through 218K.

A secondary image transferring device 222 is arranged at the opposite side to the image forming section 220 with respect to the belt 202 and includes, e.g., an endless secondary image transfer belt 224 passed over two rollers 223. The secondary image transferring device 222 is pressed against the third support roller 216 via the belt 202 so as to transfer an image formed on the belt 202 to a paper sheet or similar recording medium.

A fixing unit 225 is located at the left-hand side of the secondary image transferring device 222, as viewed in FIG. 15, and configured to fix the image transferred to the paper sheet. The secondary image transferring device 222 bifunctions as a sheet conveying device for conveying the paper sheet carrying the image thereon to the fixing unit 225. The secondary image transferring device 222 may additionally include an image transfer roller and a non-contact type charger, as needed. Sheet cassettes 244 each are loaded with a stack of paper sheets. A pickup roller 245, associated with the individual sheet cassette 244, pays out the top sheet from the sheet cassette 244 toward a sheet path 246 while separating it from the other sheets. A registration roller pair 249 is positioned on a sheet path 248 arranged in the printer 200*b*.

A full-color mode operation available with the image forming apparatus 200 will be described hereinafter.

When the operator of the image forming apparatus 200 pushes a start switch, not shown, the scanner 200*a* reads the image of a document while the printer 200*b* forms a full-color image on the a paper sheet in accordance with image data output from the scanner 200*a*.

More specifically, a drive roller, not shown, included in the image forming apparatus 200 causes the rollers 214 through 215 to rotate, causing the belt 202 to turn in the direction indicated by an arrow in FIG. 15. At the same time, the printer engines 218Y, 218M, 218C and 218K cause the respective drums to rotate so as to form a yellow, a magenta, a cyan and a black toner image thereon, respectively. Such toner images of different colors are sequentially transferred from the drums to the belt 202 one above the other, completing a full-color image on the belt 202.

On the other hand, the top paper sheet is paid out from designated one of the sheet cassettes 244 by the pickup roller 245 and conveyed to the sheet path 246. The paper sheet is then conveyed by a roller pair 247 to the sheet path 248 arranged in the printer 200*b*. The registration roller pair 249 is caused to start rotating in synchronism with the movement of the full-color image carried on the belt 202, feeding the paper sheet to a nip between the belt 202 and the secondary image transferring device 222. The secondary image transferring device 222 transfers the full-color image from the belt 202 to the paper sheet.

In the image forming apparatus 200 described above, the accuracy of drive of the belt 202 has critical influence on the quality of a full-color image to be formed on a paper sheet. In the illustrative embodiment, the scale 21 is formed at one edge of the belt 202 and sensed by the mark sensor 22, FIG. 2. With this configuration, the illustrative embodiment, like the previous embodiments, is capable of accurately generating a binary signal for controlling the amount of movement of the belt 202 even when the distance or the angle between the scale 21 and the mark sensor 22 noticeably varies and causes the quantity of light incident on the mark sensor 22 to vary. Moreover, by applying feedback control to the amount of rotation of the belt 202 or controlling the write timing, it is possible to realize accurate image formation and therefore high-definition images with a minimum of color shift.

In summary, it will be seen that the present invention can accurately generate a control signal for controlling the amount of turn of a turnable body even when a distance or an angel between a plurality of marks formed on the turnable body and a mark sensor or light-sensitive device noticeably varies and causes the quantity of light incident on the mark sensor to vary. Particularly, the present invention can accurately, stably sense the marks against the tilting or the meandering of the turnable body.

Various modifications will become possible for those skilled in the art after receiving the teachings of the present disclosure without departing from the scope thereof.

What is claimed is:

1. A mark sensing device for sensing a plurality of marks formed on a turnable body in a preselected periodic light pattern, said mark sensing device comprising:

a light source emitting a light;

a slit mask positioned on an optical path between the turnable body and the light source and formed with a plurality of slits configured to split the light emitted from said light source;

a light receiving portion configured to receive a received light and output an electric signal based on the received light, wherein the received light is the light split by said slit mask, reflected by a mark on the turnable body; and a signal generating unit configured to produce a control signal that controls an amount of turn of the turnable body from said electric signal, wherein the slit mask is positioned on an optical path between the light source and the mark on the turnable body, said plurality of slits of said slit mask each belong to either one of two slit regions one of which is shifted from the other by (2n+1)/2 (n being a natural number including zero) of the period of the preselected periodic light pattern of the plurality of marks, said light receiving portion is further configured to receive the received light in two light receiving portions each corresponding to one of said two slit regions and output two electric signals based on the received light, and said signal generating unit produces said control signal from said two electric signals output from said light receiving portion by using a crossing point of the two electric signals as a threshold value.

2. The device as claimed in claim 1, wherein said two regions are divided from each other in a direction of movement of the turnable body.

3. The device as claimed in claim 2, wherein the plurality of marks and the plurality of slits each are relatively broad in a direction perpendicular to the direction of movement of the turnable body.

4. The device as claimed in claim 3, wherein the light source is positioned in a plane perpendicular to the direction of movement of the turnable body.

5. The device as claimed in claim 4, wherein the light source is positioned such that the light emitted from said light source is incident perpendicularly on a surface of said turnable body.

6. The device as claimed in claim 5, wherein said signal generating unit produces a difference signal representative of a difference between the two electric signals and then produces a binary signal from said difference signal as the control signal.

7. The device as claimed in claim 1, wherein the plurality of marks and the plurality of slits each are relatively broad in a direction perpendicular to the direction of movement of the turnable body.

8. The device as claimed in claim 7, wherein the light source is positioned in a plane perpendicular to the direction of movement of the turnable body.

9. The device as claimed in claim 8, wherein the light source is positioned such that the light emitted from said light source is incident perpendicularly on a surface of said turnable body.

10. The device as claimed in claim 9, wherein said signal generating unit produces a difference signal representative of a difference between the two electric signals and then produces a binary signal from said difference signal as the control signal.

11. The device as claimed in claim 1, wherein the light source is positioned in a plane perpendicular to the direction of movement of the turnable body.

12. The device as claimed in claim 11, wherein the light source is positioned such that the light emitted from said light source is incident perpendicularly on a surface of said turnable body.

13. The device as claimed in claim 12, wherein said signal generating unit produces a difference signal representative of a difference between the two electric signals and then produces a binary signal from said difference signal as the control signal.

14. The device as claimed in claim 1, wherein the light source is positioned such that the light emitted from said light source is incident perpendicularly on a surface of said turnable body.

15. The device as claimed in claim 14, wherein said signal generating unit produces a difference signal representative of a difference between the two electric signals and then produces a binary signal from said difference signal as the control signal.

16. The device as claimed in claim 1, wherein said signal generating unit produces a difference signal representative of a difference between the two electric signals and then produces a binary signal from said difference signal as the control signal.

17. A mark sensing device for sensing a plurality of marks, each mark of the plurality of marks including two opposing sides, the two opposing sides being substantially parallel to each other in a first direction, formed on a turnable body in a preselected periodic light pattern, said mark sensing device comprising:

a light source emitting a light;

a slit mask positioned on an optical path between the turnable body and the light source and formed with a plurality of slits configured to split the light emitted from said light source, each slit of the plurality of slits including two opposing sides, the two opposing sides of each slit of the plurality of slits having a substantially parallel orientation in the first direction to the two opposing sides of each mark of the plurality of marks;

a light receiving portion configured to receive a received light and output an electric signal based on the received light, wherein the received light is the light split by said slit mask, reflected by a mark on the turnable body; and a signal generating unit configured to produce a control signal that controls an amount of movement of the turnable body from said electric signal, wherein the slit mask is positioned on an optical path between the light source and the mark on the turnable body, said plurality of slits of said slit mask each belong to any one of four slit regions each of which is shifted from an adjoining region by (2n+1)/4 (n being a natural number including zero) of the period of the preselected periodic light pattern of the plurality of marks, said light receiving portion is further configured to receive the received light in four light receiving portions each corresponding to one of said four slit regions and output four electric signals based on the received light, and said signal generating unit produces said control signal from said four electric signals output from said light receiving portion.

18. A device for driving a turnable body, said device comprising:

the turnable body having a plurality of marks formed thereon in a preselected periodic light pattern;

a mark sensing device for sensing the plurality of marks formed on the turnable body; and a control unit configured to control, based on a control signal output from said mark sensing device, drive of said turnable body such that an amount of movement of said turnable body remains constant;

said mark sensing device including a light source emitting a light;

a slit mask positioned on an optical path between the turnable body and the light source and formed with a plurality of slits configured to split the light emitted from the light source;

a light receiving portion configured to receive a received light and output an electric signal based on the received light, wherein the received light is the light split by said slit mask, reflected by a mark on the turnable body; and a signal generating unit configured to produce a control signal that controls the amount of movement of said turnable body from said electric signal, wherein the slit mask is positioned on an optical path between the light source and the mark on the turnable body, said plurality of slits of said slit mask each belong to either one of two slit regions one of which is shifted from the other by a period of(2n+1)/2 (n being a natural number including zero) of the period of the preselected periodic light pattern of the plurality of marks, said light receiving portion is further configured to receive the received light in two light receiving portions each corresponding to one of said two slit regions and output two electric signals based on the received light, and said signal generating unit produces the control signal from said two electric signals output from said light receiving portion by using a crossing point of the two electric signals as a threshold value.

19. A device for driving a turnable body, said device comprising:

said turnable body having a plurality of marks formed thereon in a preselected periodic light pattern, each mark of the plurality of marks including two opposing sides, the two opposing sides being substantially parallel to each other in a first direction;

a mark sensing device for sensing the plurality of marks formed on said turnable body; and a control unit configured to control, based on a control signal output from said mark sensing device, drive of said turnable body such that an amount of movement of said turnable body remains constant;

said mark sensing device including a light source emitting a light;

a slit mask positioned on an optical path between the turnable body and the light source and formed with a plurality of slits configured to split the light emitted from said light source, each slit of the plurality of slits including two opposing sides, the two opposing sides of each slit of the plurality of slits having a substantially parallel orientation in the first direction to the two opposing sides of each mark of the plurality of marks;

a light receiving portion configured to receive a received light and output an electric signal based on the received light, wherein the received light is the light split by said slit mask, reflected by a mark on the turnable body based on the received light; and a signal generating configured to produce a control signal that controls the amount of movement of said turnable body from said electric signal, wherein the slit mask is positioned on an optical path between the light source and the mark on the turnable body, said plurality of slits of said slit mask each belong to any one of four slit regions each of which is shifted from an adjoining slit region by a period of(2n+1)/4 (n being a natural number including zero) of the period of the preselected periodic light pattern of the plurality of marks, said light receiving portion is further configured to receive the received light in four light receiving portions each corresponding to one of said four slit regions and outputs four electric signals based on the received light, and said signal generating unit produces said control signal from said four electric signals output from said light receiving portion.

20. An image forming apparatus including a device for driving a turnable body, said device for driving the turnable body comprising:

said turnable body having a plurality of marks formed thereon in a preselected periodic light pattern;

a mark sensing device for sensing the plurality of marks formed on said turnable body; and a control unit configured to control, based on a control signal output from said mark sensing device, drive of said turnable body such that an amount of rotation of said turnable body remains constant;

said mark sensing device including a light source emitting a light;

a slit mask positioned on an optical path between said turnable body and said light source and formed with a plurality of slits configured to split the light emitted from said light source;

a light receiving portion configured to receive a received light and output an electric signal based on the received light, wherein the received light is the light split by said slit mask, reflected by a mark on the turnable body; and a signal generating unit configured to produce a control signal that controls the amount of movement of said turnable body from said electric signal, wherein the slit mask is positioned on an optical path between the light source and the mark on the turnable body, said plurality of slits of said slit mask each belong to either one of two slit regions one of which is shifted from the other by a period of(2n+1)/2 (n being a natural number including zero) of the period of the preselected periodic light pattern of the plurality of marks, said light receiving portion is further configured to receive the received light in two light receiving portions each corresponding to one of said two slit regions and output two electric signals based on the received light, and said signal generating unit produces said control signal from said two electric signals output from said light receiving portion by using a crossing point of the two electric signals as a threshold voltage.

21. An image forming apparatus including a device for driving a turnable body, said device for driving the turnable body comprising:

said turnable body having a plurality of marks formed thereon in a preselected periodic light pattern, each mark of the plurality of marks including two opposing sides, the two opposing sides being substantially parallel to each other in a first direction;

a mark sensing device for sensing the plurality of marks formed on said turnable body; and a control unit configured to control, based on a control signal output from said mark sensing device, drive of said turnable body such that an amount of rotation of said turnable body remains constant;

said mark sensing device including a light source emitting a light;

a slit mask positioned on an optical path between said turnable body and said light source and formed with a plurality of slits configured to split the light emitted from said light source, each slit of the plurality of slits including two opposing sides, the two opposing sides of each slit of the plurality of slits having a substantially parallel orientation in the first direction to the two opposing sides of each mark of the plurality of marks;

a light receiving portion configured to receive a received light and output an electric signal based on the received light, wherein the received light is the light split by said slit mask, reflected by a mark on the turnable body; and a signal generating configured to produce a control signal that controls the amount of rotation of said turnable body from said electric signal, wherein the slit mask is positioned on an optical path between the light source and the mark on the turnable body, said plurality of slits of said slit mask each belong to any one of four slit regions each of which is shifted from an adjoining slit region by (2n+1)/4 (n being a natural number including zero) of the period of the preselected periodic light pattern of the plurality of marks, said light receiving portion is further configured to receive the received light in four light receiving portions each corresponding to one of said four slit regions and outputs four electric signals based on the received light, and said signal generating unit produces said control signal from said four electric signals output from said light receiving portion.

22. The mark sensing device according to claim 1, wherein each mark of the plurality of marks includes two opposing sides, the two opposing sides being substantially parallel to each other in a first direction; and each slit of the plurality of slits includes two opposing sides, the two opposing sides of each slit of the plurality of slits having a substantially parallel orientation in the first direction to the two opposing sides of each mark of the plurality of marks.

23. The device for driving the turnable body according to claim 18, wherein each mark of the plurality of marks includes two opposing sides, the two opposing sides being substantially parallel to each other in a first direction; and each slit of the plurality of slits includes two opposing sides, the two opposing sides of each slit of the plurality of slits having a substantially parallel orientation in the first direction to the two opposing sides of each mark of the plurality of marks.

24. An image forming apparatus according to claim 20, wherein each mark of the plurality of marks includes two opposing sides, the two opposing sides being substantially parallel to each other in a first direction; and each slit of the plurality of slits includes two opposing sides, the two opposing sides of each slit of the plurality of slits having a substantially parallel orientation in the first direction to the two opposing sides of each mark of the plurality of marks.

* * * * *